US008489013B2

(12) United States Patent
Kanda

(10) Patent No.: US 8,489,013 B2
(45) Date of Patent: Jul. 16, 2013

(54) INTERMEDIARY CONVEYANCE APPARATUS AND IMAGE FORMING SYSTEM HAVING A BLOWER FOR CONTROL OF SHEETS

(75) Inventor: Takanori Kanda, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 300 days.

(21) Appl. No.: 12/936,506

(22) PCT Filed: Mar. 31, 2009

(86) PCT No.: PCT/JP2009/056625

§ 371 (c)(1),
(2), (4) Date: Oct. 5, 2010

(87) PCT Pub. No.: WO2009/125694

PCT Pub. Date: Oct. 15, 2009

(65) Prior Publication Data

US 2011/0026995 A1 Feb. 3, 2011

(30) Foreign Application Priority Data

Apr. 8, 2008 (JP) ..... 2008-100183

(51) Int. Cl.
*G03G 15/00* (2006.01)
*B65H 29/24* (2006.01)

(52) U.S. Cl.
USPC ..... 399/407; 271/195

(58) Field of Classification Search
USPC ..... 399/407, 408, 410; 271/195
See application file for complete search history.

(56) References Cited

U.S. PATENT DOCUMENTS 5,855,367 A * 1/1999 Inoue et al. ..... 271/186

FOREIGN PATENT DOCUMENTS

| | | | |
|---|---|---|---|
| JP | H02-106552 | | 4/1990 |
| JP | H09-240898 | | 9/1997 |
| JP | 2931447 | | 5/1999 |
| JP | 2002-268289 | | 9/2002 |
| JP | 2003089473 | * | 3/2003 |
| JP | 2005112568 | * | 4/2005 |
| JP | 2007279550 | * | 10/2007 |

OTHER PUBLICATIONS

English-language International Search Report from the Japanese Patent Office mailed Jun. 30, 2009, for International Application No. PCT/JP2009/056625.
Japanese Office Action issued in Japanese Patent Application No. 2010-507216 mailed Oct. 23, 2012.

* cited by examiner

*Primary Examiner* — Judy Nguyen
*Assistant Examiner* — Blake A Tankersley
(74) *Attorney, Agent, or Firm* — Finnegan, Henderson, Farabow, Garrett & Dunner, L.L.P.

(57) ABSTRACT

When a sheet is brought into a sheet storage section (12), a fan 126 creates an air current towards the sheet storage part (12), and when the sheet is discharged from the sheet storage section (12), the fan stops air blow. Whereby, the conveyance of the sheet to the sheet storage section (12) is guided, and discharging of the sheet from the sheet storage section is smoothly carried out.

12 Claims, 13 Drawing Sheets

INTERMEDIARY CONVEYANCE APPARATUS AND IMAGE FORMING SYSTEM HAVING A BLOWER FOR CONTROL OF SHEETS

TECHNICAL FIELD

The present invention relates to an intermediary conveyance device and an image forming system including the intermediary conveyance device.

PRIOR ART

In operation to convey a sheet and stack a plurality of the sheets, when a sheet conveyed subsequently (a successive sheet) is stacked on a sheet (a precedent sheet) conveyed and stacked in advance, there is a problem that the successive sheet contacts with the precedent sheet and alignment of a plurality of sheets stacked is disturbed.

In the Patent Document 1(Japanese Patent No. 2931447), in order to solve the above problem, a laminar air is flowing between an obverse surface of the sheet stacked on the sheet discharging table and a reverse surface of the sheet to be subsequently discharged.

Patent Document 1: Japanese Patent No. 2931447

DISCLOSURE OF THE INVENTION

Problems to be Solved by the Invention

According to the conveyance and sheet discharging method disclosed in Patent Document 1, misalignment due to contact between the sheet stacked in advance and the sheet subsequently discharged is obviated.

However, in case the conveyance and sheet discharging method described in the Patent document 1 is applied to an intermediary conveyance device which receives a sheet from a processing apparatus in an upstream side and discharge the sheet towards a processing apparatus in a downstream side, there are problems described as follow.

In the intermediary conveyance device the sheet has to be delivered from the apparatus in the upstream side and discharged to the apparatus in the downstream side. When the sheet is brought into the sheet storing section of the intermediary conveyance device, it is effective that the sheet is guided by an air current so as to convey the sheet smoothly.

However, in the intermediary conveyance device, since the sheet is discharged towards the processing apparatus in the downstream side, there is a case that the aforesaid air current affects discharging of the sheet, and the sheet cannot be discharged smoothly.

Also, in case the intermediary conveyance apparatus having the sheet aligning device performs the aligning process inside the intermediary conveyance apparatus and conveys the sheet to the processing apparatus in downstream side, the aligning process is disturbed by the aforesaid air current.

The present invention has one aspect to solve the above problems in the intermediary conveyance apparatus.

Means to Resolved the Problem

An object of the present invention is achieved by the following.

Item 1: An intermediary conveyance apparatus having a sheet storing section to store a sheet, a sheet entering section to convey the sheet to the sheet storing section and a sheet discharging section to discharge the sheet stored in the sheet storing section, including: a blower device to blow air to the sheet storing section; and an intermediary conveyance control device to control the blower device, wherein the intermediary conveyance control device controls the blower device to blow air to the sheet storing section when the sheet is conveyed from the sheet entering section to the sheet storing section, and to stop air blow to the sheet storing section when the sheet is discharged from the sheet storing section via the sheet discharging section.

Item 2: An intermediary conveyance apparatus having a sheet storing section to store a sheet, a sheet entering section to convey the sheet to the sheet storing section and a sheet discharging section to discharge the sheet stored in the sheet storing section, including: a blower device to blow air to the sheet storing section; a sheet aligning device to align the sheet stored in the sheet storing section; and an intermediary conveyance control device to control the blower device and the sheet aligning device, wherein the intermediary conveyance control device controls the aligning device and the blower device to blow air to the sheet storing section when the sheet is conveyed from the sheet entering section to the sheet storing section, and to stop air blow to the sheet storing section when an aligning process by the sheet aligning device is completed.

Item 3: The intermediary conveyance apparatus of item 1, wherein the sheet aligning device performs longitudinal aligning.

Item 4: The intermediary conveyance apparatus of any one of items 1 to 3, wherein the sheet storing section stores a plurality of the sheets.

Item 5: The intermediary conveyance apparatus of any one of items 1 to 4, wherein the intermediary conveyance control device control the blower section to blow air to the sheet storing section when the plurality of the sheets are stored in the sheet storing section and to stop air blow when the plurality of the sheets are not stored in the sheet storing section.

Item 6: The intermediary conveyance apparatus of any one of items 1 to 5, wherein the sheet storing section reverses the sheet in a way that a conveyance direction of the sheet when the sheet is conveyed from the sheet entering section opposes a conveyance direction of the sheet when the sheet is discharged from the sheet discharging section.

Item 7: The intermediary conveyance apparatus of any one of items 1 to 6, wherein the intermediary conveyance control section controls the blower device based on a sheet detection signal of a sensor provided at the sheet entering section.

Item 8: The intermediary conveyance apparatus of any one of items 1 to 7, wherein the blower device includes a restriction member to restrict an air current, wherein the intermediary conveyance control device controls the restriction member so as to start and stop air blow to the sheet storing section.

Item 9: The intermediary conveyance apparatus of any one of items 1 to 8, wherein the sheet storing section stores the sheet in a vertical state and the blower device is provided with a fan disposed above the sheet storing section.

Item 10: The intermediary conveyance apparatus of item 9, further comprising: a conveyance path to convey the sheet from the sheet entering section to the sheet discharging section without passing through the sheet storing section, and a guide member configuring the conveyance path is provided with a hole through which the air current from the fan goes.

Item 11: The intermediary conveyance apparatus of any one of items 1 to 10, wherein the sheet conveyance section is provided with a guide member for restriction to move the sheet stored in the sheet storing section to a sheet discharging side.

Item 12: An image forming system, having an image forming apparatus, the intermediary conveyance apparatus of any one of items 1 to 11, and a post-processing apparatus, to convey the sheet from the image forming apparatus to the post processing apparatus via the intermediary conveyance apparatus, wherein the image forming apparatus includes a linear sheet discharging function, a reversal sheet discharging function and a main control device, the intermediary conveyance apparatus includes a linear conveyance function and a reversal conveyance function, the main control device selects the linear sheet discharging function or the reversal sheet discharging function, and the intermediary conveyance control apparatus selects and uses the linear conveyance function or the reversal conveyance function based on information acquired from the main control device.

Item 13: The image forming system of item 12, wherein the intermediary conveyance control device selects the linear conveyance function or the reversal conveyance function based on at least one item of information from the main control device regarding image forming mode in the image forming apparatus, a size of the sheet, a kind of the sheet, an environment and post-processing in the post-processing apparatus.

Effect of the Invention

According to the present invention, when the sheet is brought into the sheet storing section, since the sheet is guided by the air current towards the sheet storing section generated by a blower, the sheet is conveyed to the sheet storing section smoothly.

When the sheet is conveyed form the sheet storing section to the sheet conveyance section, since the air blast ceases the sheet is discharged smoothly.

As a result, conveyance and discharge of the sheet in the intermediary conveyance device is carried out smoothly, high speed conveyance is possible irrespective of size and kind of the sheet.

DESCRIPTION OF THE SYMBOLS

11 Sheet entering section
12 Sheet storing section
13 Sheet detection section
123 Sheet stopper
R1, R2, R6 and R7 Roller pairs
R3, R4 and R5 Rollers
G1, G2, G3, G4, G5 and G6 Guide sections
9A Main control device
9B Intermediary conveyance control device
SE Sensor

DESCRIPTION OF THE PREFERRED EMBODIMENTS

The present invention will be described with reference to the drawings without the present invention being restricted by the drawings thereof.

Figure 1:
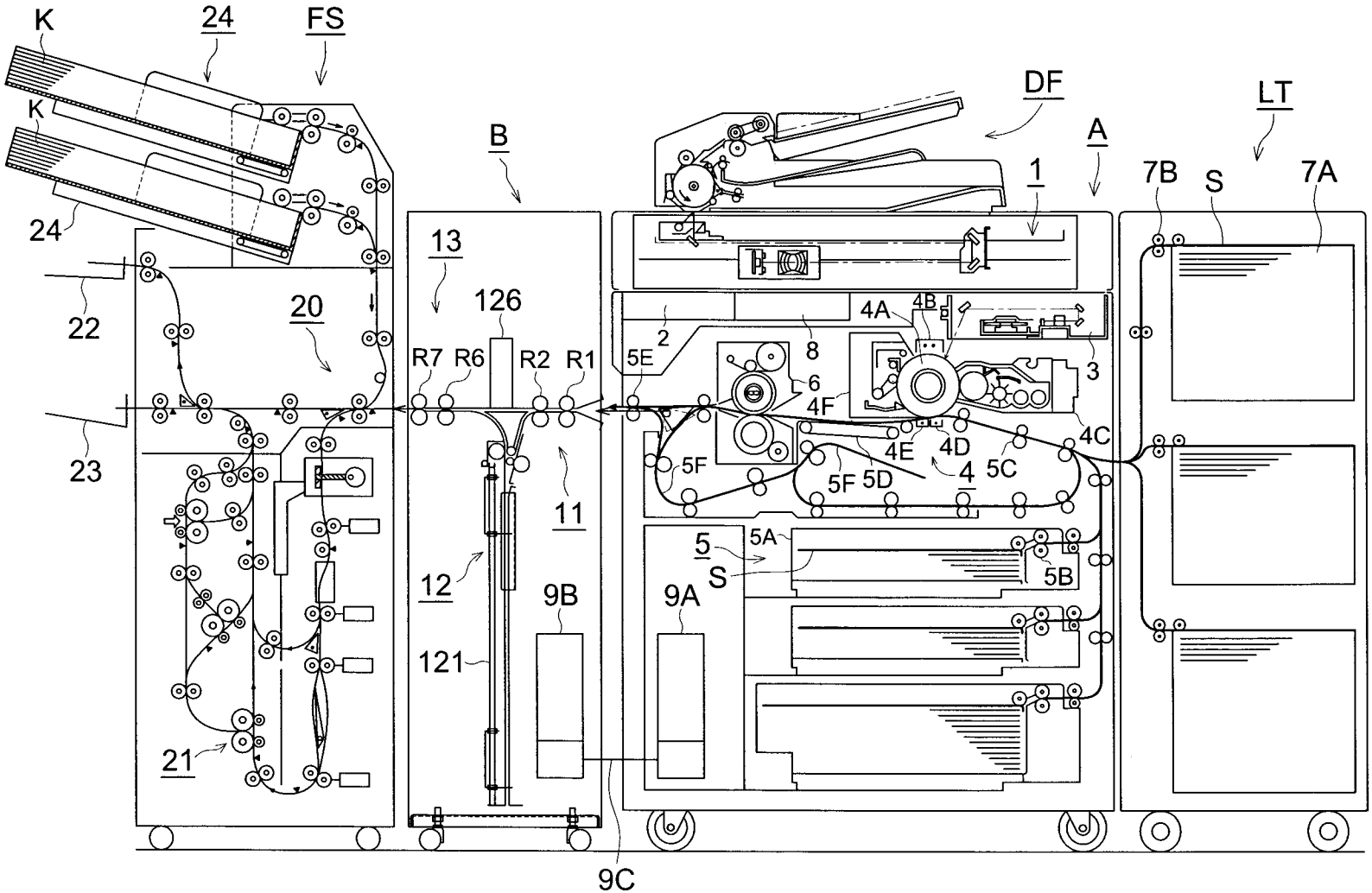
FIG. 1 is an entire structure of the image forming system related to an embodiment of the present invention.

FIG. 1 is an entire structure of an image forming system related to an embodiment of the present invention.

[Image Forming System]

An image forming apparatus A shown by the figure is provided with an image reading section 1, an image processing section 2, an image writing section 3, an image forming section 4, a sheet conveyance device 5 and a fixing device 6.

The image forming section 4 is configured with a photoconductive drum 4A, a charging device 4B, a developing device 4C, a transfer device 4D and a separation device 4E and a cleaning device 4F.

The sheet conveyance device 5 is provided with a sheet feeding cassette 5A, a first sheet feeding device 5B, a second sheet feeding device 5C, a conveyance device 5D, a sheet discharging device 5E and an automatic duplexing unit (ADU) 5F.

On a front side of an upper section of the image forming apparatus A, an operation display device 8 configured with an input device and a display device is disposed. At the upper section of the image forming apparatus A, an automatic document feeding apparatus DF is disposed. At a sheet discharging device 5E side i.e. left side surface of the image forming apparatus A in the figure, an intermediary conveyance apparatus B is connected and a post-processing apparatus FS is further connected at a left side thereof.

A document is placed on the document table of the automatic document feeding apparatus DF and images of the document on one side or both sides are read via an optical system of the image reading section 1. An analogue signal having been subject to photoelectric conversion is sent to the image writing section 3 after processing such as analogue processing, A/D conversion, shading correction and image compression in the image processing section 2.

In the image writing section 3, the photoconductive drum 4A of the image forming section 4 is irradiated with an output light from a semiconductor laser so as to form a latent image. In the image forming section 4, processing such as charging, exposing developing, transferring, separating and cleaning are conducted.

On a sheet S fed from a first sheet feeding device 5B, an image is transferred via a transfer device 4D. The sheet S carrying the image is fixed via the fixing device 6 and conveyed to the intermediary conveyance apparatus B from the sheet discharging device 5E. Or, a sheet S after being subject to one side image processing conveyed to the automatic duplexing unit (ADU) 5F is subject to both side image processing in the image forming section 4, after that the sheets is discharged via the sheet discharging device 5E and conveyed to the intermediary conveyance apparatus 13.

A main control device 9A disposed in the image forming apparatus A and the intermediary conveyance control device 9B disposed in the intermediary conveyance apparatus B are connected with a communication circuitry 9C to transmit and receive a input signal and a control signal.

A large capacity sheet feeding apparatus LT configured with a sheet stacking device 7A and a first sheet feeding device 7B conveys a large amount of the sheets S and sent to the image forming apparatus A.

Meanwhile, the large capacity sheet feeding apparatus LT can be connected with the intermediary conveyance apparatus B to be described, so that a large amount of the sheet S stored in the large capacity sheet feeding apparatus LT can be sent to the intermediary conveyance apparatus B directly.

In the intermediary conveyance apparatus B is a conveyance device to pass the sheets from the image forming apparatus A to the post-processing apparatus FS without reducing the productivity of the entire system in case a difference of processing ability exists between the image forming apparatus A and the post-processing apparatus.

The post-processing apparatus FS is provided with a conveyance section 20 to convey the sheet S and a coversheet K discharged from the intermediary conveyance apparatus B, a folding section 21 to perform folding such as double folding and triple folding for the sheet S and the coversheet K and a sheet discharging tray 22 to which a small amount of the sheets S are discharged and an sheet discharging tray 23 to which a large amount of the sheets S and the coversheet K are discharged.

A numeral 24 denoted a sheet feeding tray to supply the coversheet K to be added to the sheet S discharged from the image forming apparatus A.

The sheet S conveyed from the image forming apparatus A to the post-processing apparatus FS via the intermediary conveyance apparatus B is conveyed horizontally, and discharged to sheet discharging trays 22 and 23 without being processed.

Or, the sheet S conveyed to the post-processing apparatus FS is conveyed to the folding section 21 and after folding processing via folding section 21, the sheet S is discharged to the sheet discharging tray 23.

Further, in the same manner, the coversheet K fed from the sheet feeding tray 24 is discharged to the sheet discharging try 23 with or without having been subject to folding process.

In the embodiment in the figure, the post-processing apparatus FS performs folding processing, and the post-processing apparatus having functions to perform various kinds of processing can be connected after the intermediary conveyance apparatus B.

Also, a plurality of the conveyance apparatus can be connected after the intermediary conveyance apparatus B.

As the post-processing apparatus, one having one or more functions such as a perforation processing, stapling processing, and book binding processing can be connected at the downstream sided of the intermediary conveyance apparatus B.

Figure 2:
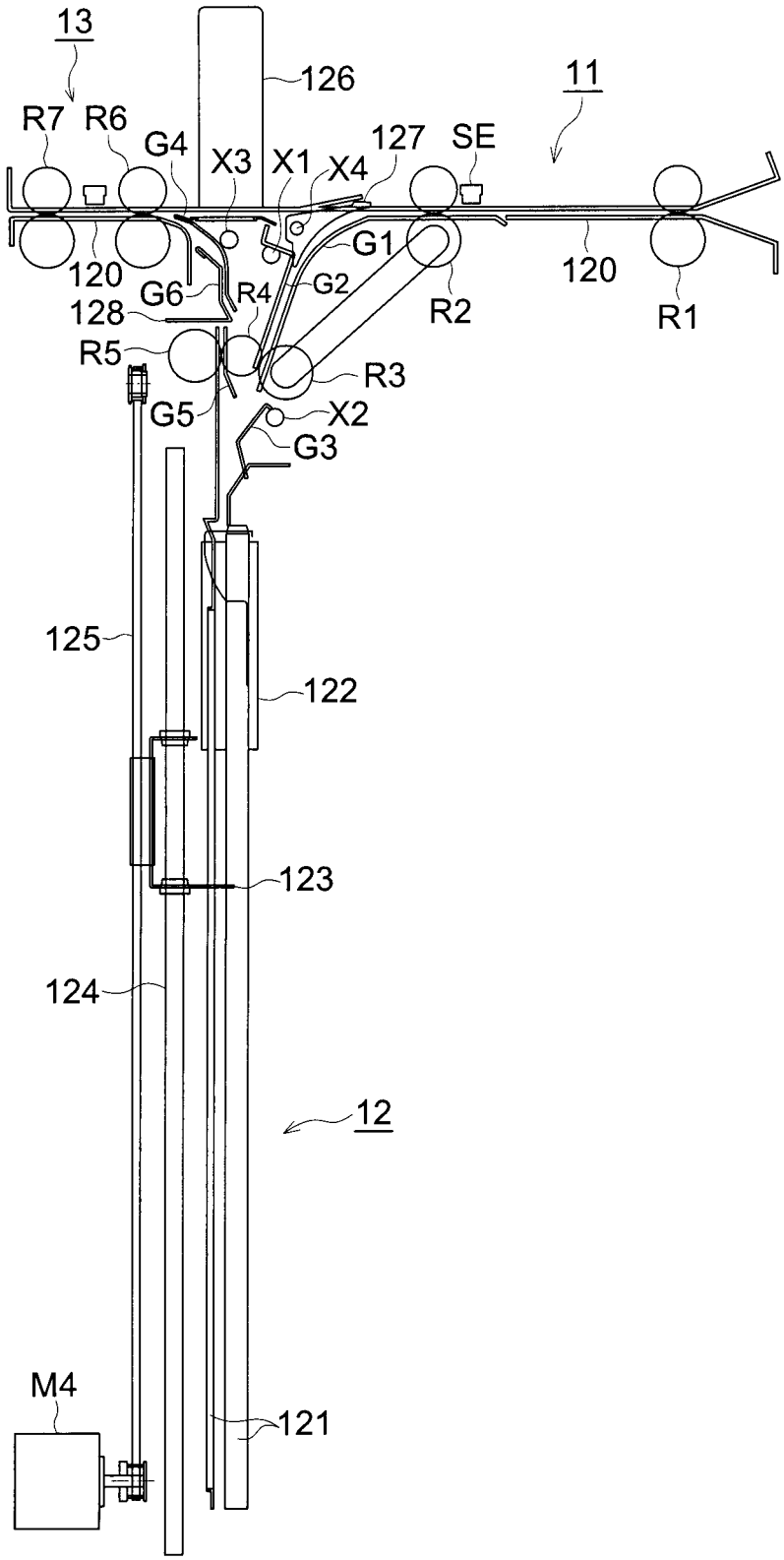
FIG. 2 is an explanatory diagram of the conveyance path when an intermediary conveyance apparatus B is viewed from a perpendicular direction with respect to a conveyance direction.
Figure 3:
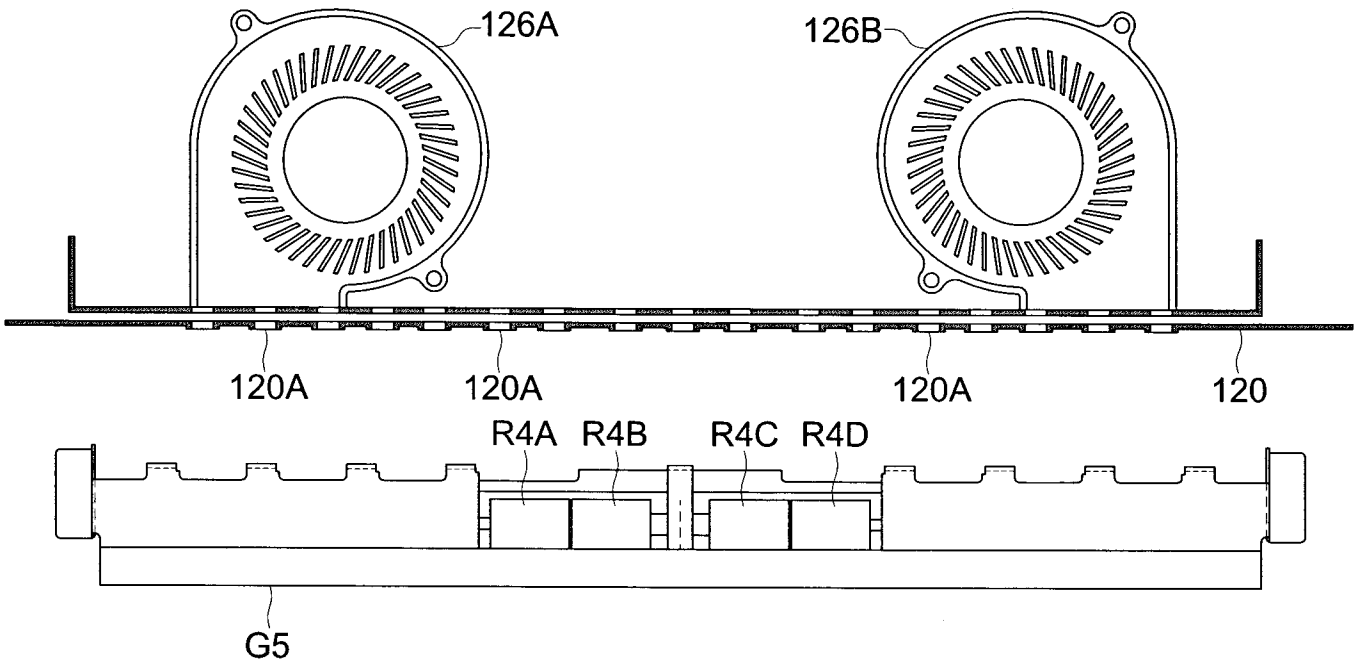
FIG. 3 is an explanatory diagram of a fan and a conveyance path when an intermediary conveyance apparatus B is viewed from a perpendicular direction with respect to a conveyance direction.

FIGS. 2 and 3 show main structures of the intermediary conveyance apparatus B related to the embodiment of the present invention. FIG. 2 is an explanatory diagram of the conveyance path when viewing the intermediary conveyance apparatus B from a direction perpendicular to the conveyance path, and FIG. 3 is an explanatory diagram of a fan and a conveyance path when viewing the intermediary conveyance apparatus from a conveyance direction.

<Structure of Intermediary Conveyance Apparatus B>

The intermediary conveyance apparatus B is provided with a sheet entering section 11, sheet storing section 12 and sheet discharging section 13 (FIG. 1).

As FIG. 2 shows, the sheet entering section 11 receives and conveys the sheet discharged form the image forming apparatus A and the sheet storing section 12 to receive the sheet from the sheet entering section 11 and reverse a conveyance direction can store a plurality of the sheets. The sheet discharging section 13 discharges the sheet whose conveyance direction is reversed via the sheet storing section 12.

The intermediary conveyance apparatus B has a conveyance mode in which the sheet from the sheet entering section 11 is discharged from the sheet discharging section 13 via the sheet storing section 12 and a conveyance mode in which the sheet is conveyed from the sheet conveyance section 11 to the sheet discharging section 13 and discharged from the sheet discharging section 13.

As FIG. 2 shows, the sheet entering section 11 is provided with a roller pair R1, a roller pair R2, a roller R3, and guide members 120, G1, G2 and G3. The guide member 120 is a fixed guide member to guide the sheet horizontally, and the guide members G1 and G2 are a guide member to guide the sheet from a horizontal state to a vertical state. The guide member G1 is a stationary guide member.

The guide member G2, the roller R4 and the guide member G5 configure an integral rotatable block centering around an axis X1, and the block is driven by a solenoid SOL2 (refer to FIG. 12) to rotate.

The guide members G2 and G5 guide the sheet and configure a restriction member to restrict a direction of an air current generated by a fan 126.

The roller R4 in contact with and rotated by the roller R5, and the roller R5 is driven by a motor M2 to rotate.

The roller pairs R1 and R2 and the roller R3 are driven by a motor M1 (refer to FIG. 12) to rotate. The roller R3 is supported by an unillustrated lever which rotates around an axis of a lower roller of the roller pair R2 and displaced by rotation of the lever driven by the solenoid SOL 1 (refer to FIG. 12).

The roller R4 is configured with four rollers R4A, R4B, R4C and R4D as FIG. 3 shows.

The rollers R4B and R4C located in a center section in the width direction (a direction perpendicular to the sheet conveyance direction) are in contact with the roller R3, and the rollers R4A and R4D at both end sections are in contact with the roller R5.

The rollers R3 and R4 are disposed at an end of the downstream side of the conveyance path formed by the guide members G1 and G2, and the guide member G3 is disposed at a downstream side of the roller R3.

The guide member G3 is rotatable around an axis X2 and driven by a solenoid SOL3 (refer to FIG. 12) to rotate.

Meanwhile, the meanings of the upstream and downstream sides are based on the sheet conveyance direction.

The sheet storing section 12 is provided with a pair of stationary sheet retaining boards 121 being parallel each other and extending in a vertical direction, a width aligning device 122 and a sheet stopper 123.

In the sheet entering section 11, the front end of the sheet conveyed comes to contact with the sheet stopper 123 and stops, and then the sheet is held in a vertical state with the sheet holding board 121.

The sheet aligning device 122 is a device to align the sheet in the width direction. The sheet aligning device 122 is driven by a motor M3 (refer to FIG. 12) to be reciprocated in the width direction of the sheet so as to bookend the sheet.

The sheet stopper 123 being guided by a vertical guide bar 124 is driven by a motor M4 (refer to FIG. 12) and the belt 125 so as to move up and down.

The stopper 123 moves up and down in accordance with the size of the sheet besides it moves in a sheet conveyance process to be described.

The sheet discharging section 13 is provided with a pair of guide members 120 representing a stationary guide member, a fixed guide member G4, movable guide members G5, G6, a roller R5 and roller pairs R6 and R7. The guide member G6 moves while being supported by an unillustrated lever which is driven by the solenoid SOL4 (refer to FIG. 12) so as to rotate around the axis X3.

A numeral 126 denotes a fan to send the air current to the sheet entering port section of the sheet storing section 12.

The fan 126 is configured with two fans 126A and 126 B disposed in parallel in the width direction as FIG. 3 shows. The two fans 126A and 126B generate an even air flow in the width direction.

At the guide member 120 configuring the conveyance path, multiple openings (holes) 12A are disposed in a uniform distribution in the width direction as FIG. 3 shows, and an air flow from the fan 126 flows to a downstream side via the openings 120A.

A numeral 127 denotes a changeover gate driven by a solenoid SOL5 (refer to FIG. 12) to change whether the sheet is conveyed horizontally or conveyed to the sheet storing section 12.

A numeral 128 denotes a longitudinal aligning board driven by a solenoid SOL4 (refer to FIG. 12) to restrict an upper end of the sheet to be. The guide member G6 and the longitudinal aligning board 128 are configured with an integral member. When the solenoid SOL 4 is turned off, the longitudinal aligning board appears in the sheet conveyance path so as to stop the upper end of the sheet to be conveyed.

When the solenoid SOL4 turns on, the longitudinal aligning board 128 is retracted from the sheet conveyance path, and the guide member G6 rotates around the axis X3 so as to open the space between the opposing guide member G4 and forms the sheet conveyance path.

<Operation of Intermediary Conveyance Apparatus>

An operation of the intermediary conveyance apparatus B will be described with reference to FIGS. 4 to 13.

FIGS. 4 to 11 are cross-sectional views of the intermediary conveyance apparatus B showing stages 1 to 8 in the operation to convey the sheet.

Figure 12:
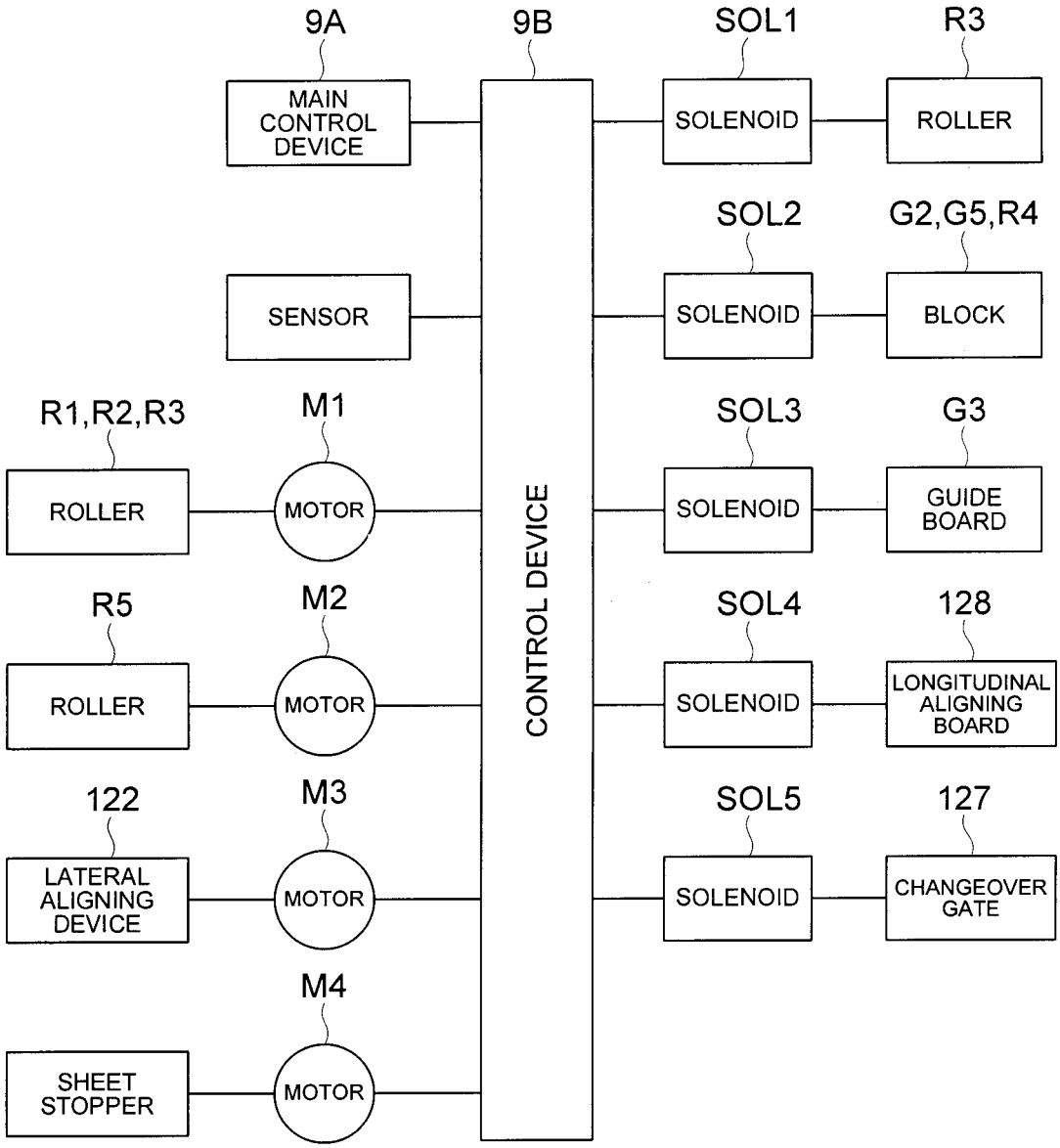
FIG. 12 is a block section of a control system of the intermediary conveyance apparatus B.
Figure 13:
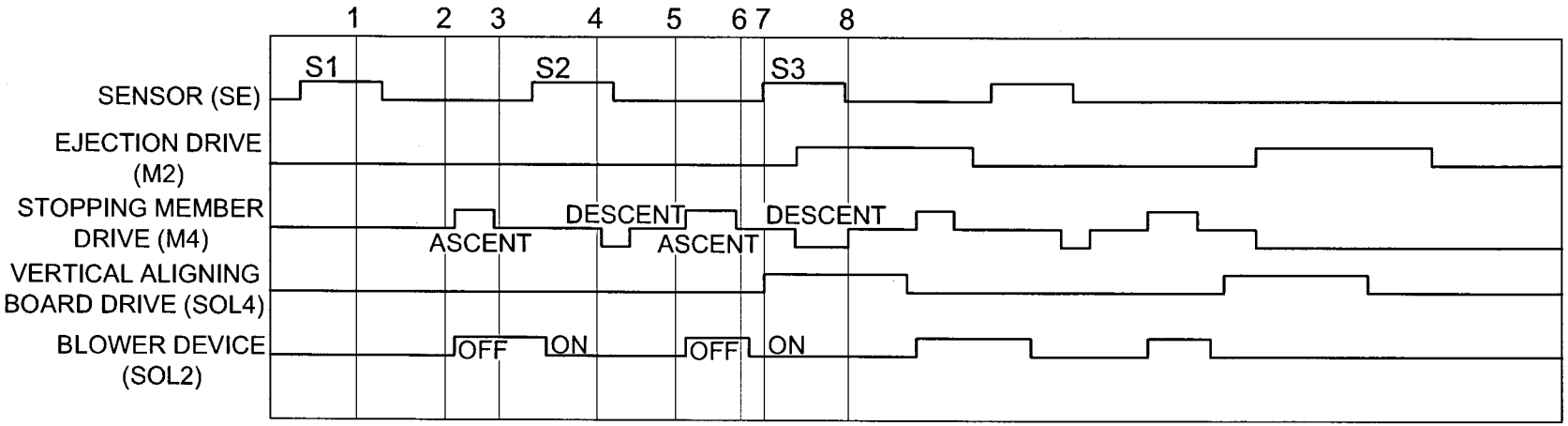
FIG. 13 is a timing chart of an operation of the intermediary conveyance apparatus B.

FIG. 12 is a block diagram of a control system of the intermediary conveyance apparatus B, and FIG. 13 shows a timing chart of the operation of the intermediary conveyance apparatus B.

An intermediary conveyance control device 9B disposed in the intermediary conveyance apparatus B conducts control operation shown in FIG. 13 based on information from a main control device 9A disposed in the image forming apparatus A and a sheet detection signal of a sensor SE disposed at the sheet entering section 11.

A starting timing of each section in FIG. 13 is determined by sheet detection signal of the sensor SE.

Figure 4:
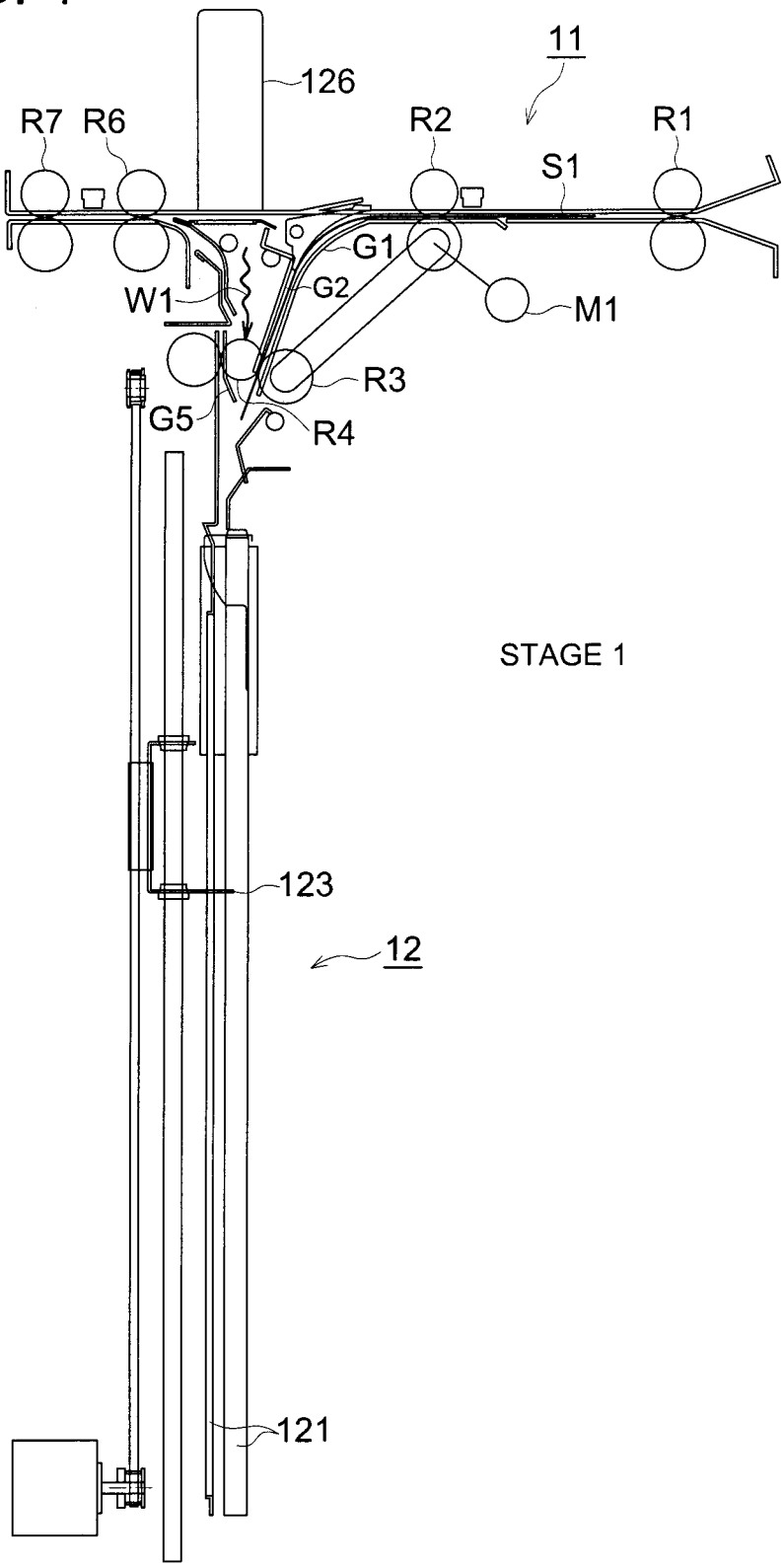
FIG. 4 is a front cross-sectional view of the intermediary conveyance apparatus B.

In FIG. 13, to perform discharging drive, the motor M2 operates to drive the roller R5 to perform stopping member drive, stop member drive and to perform longitudinal aligning board drive, the solenoid SOL 4 operates to retract the longitudinal aligning board 128 from a aligning position In FIG. 13, the stopping member drive is described by operation of the motor M4 i.e. obverse rotation, reverse rotation and stop, and in an initial sate, the sheet stopper 123 is at a height shown in FIG. 4.

After the motor M4 performs an operation shown by "ascent", the sheet stopper 123 is set at an ascended height, and after the motor M4 performs an operation shown by "descent" the sheet stopper 123 is set at a descended height.

The blower device is configured with the fan 126 and the guide members G2 and G5 representing restriction members to restrict a direction of the air current. Operation of the blower device includes operating the solenoid SOL2, displacing the guide members G2 and G5, and changing the air current from a direction W1 to a direction W2.

Longitudinal aligning is an aligning process to align the sheet in the conveyance direction. The longitudinal aligning board drive is indicated by on and off of the solenoid SOL4 to drive the longitudinal aligning board 128.

As described above, while the solenoid SOL4 is on, the longitudinal aligning board 128 is retracted from the sheet conveyance path.

Longitudinal aligning is performed by ascending the sheet stopper 123 while the longitudinal aligning board appears in the sheet conveyance path so as to contact the upper end of the sheet with the longitudinal aligning board 128. Incidentally, the sheet aligning device in the present embodiment is configured with the longitudinal aligning board 128, the solenoid SOL4, the sheet stepper 123, the motor M4, the width aligning device 122 and the motor M3.

In FIG. 13, ascent of the sheet stopper 123 between stages 5 and 6 shows a longitudinal aligning process.

As FIG. 13 shows, longitudinal aligning is performed while the blower device is stopped. Further specifically, the blower device is stopped until aligning is completed.

Numerals 1 to 8 in FIG. 13 correspond to stages 1 to 8 shown by FIGS. 3 to 10.

In the sheet conveyance process of the intermediary conveyance apparatus B to be described, the fan 126 operates continuously and the air current is switched between the direction W1 to guide conveyance of the sheet and the direction W2 not to guide conveyance of the sheet and not to disturb aligning of the sheet and discharging of the sheet from the sheet storing section 12.

Incidentally, the blower device in FIG. 13 can be turned on and off by tuning on and off the fan 12, instead of changing the directions of the air current by the air current restriction device (guide members G2 and G5) as the embodiment.

The air current flowing in the direction shown by W1 conveys the sheet smoothly in the entering port section of the sheet storing section 12 and the sheet storing section 12, and the lower end of the sheet reaches to the sheet stopper 123 unfailingly.

The roller pairs R1 and R2 and the roller R3 continuously rotates by driving the motor M1.

As FIG. 4 shows, the first sheet S1 discharged form the image forming apparatus A is conveyed horizontally via the roller pairs R1 and R2 to the sheet conveyance section 11 and detected by the sensor SE (stage 1).

At a sheet entering step showing in FIG. 4, the rollers R3, R4 and R5 are in contact each other and the roller pairs R1 and R2 and the roller R3 is driven by the motor M1 to rotate so as to convey the sheet S1.

In a sheet entering stage, the air current from the fan 126 flows downward as a wave shaped arrow W1 shows so that a resistance of the guide member with respect to the sheet S1 is reduced.

In a process of conveyance of the sheet S1 from the sheet entering section 11 to the sheet storing section 12, falling of the sheet S1 may be interrupted by a resistance due to frictions of the guide members G1, G2 and G5, and sheet retaining board 121. However, by the air blow shown by the arrow W1, conveyance of the sheet S1 is conducted smoothly.

A direction of the air current shown by the arrow W1 is a direction restricted by the guide members G2 and G5.

Figure 5:
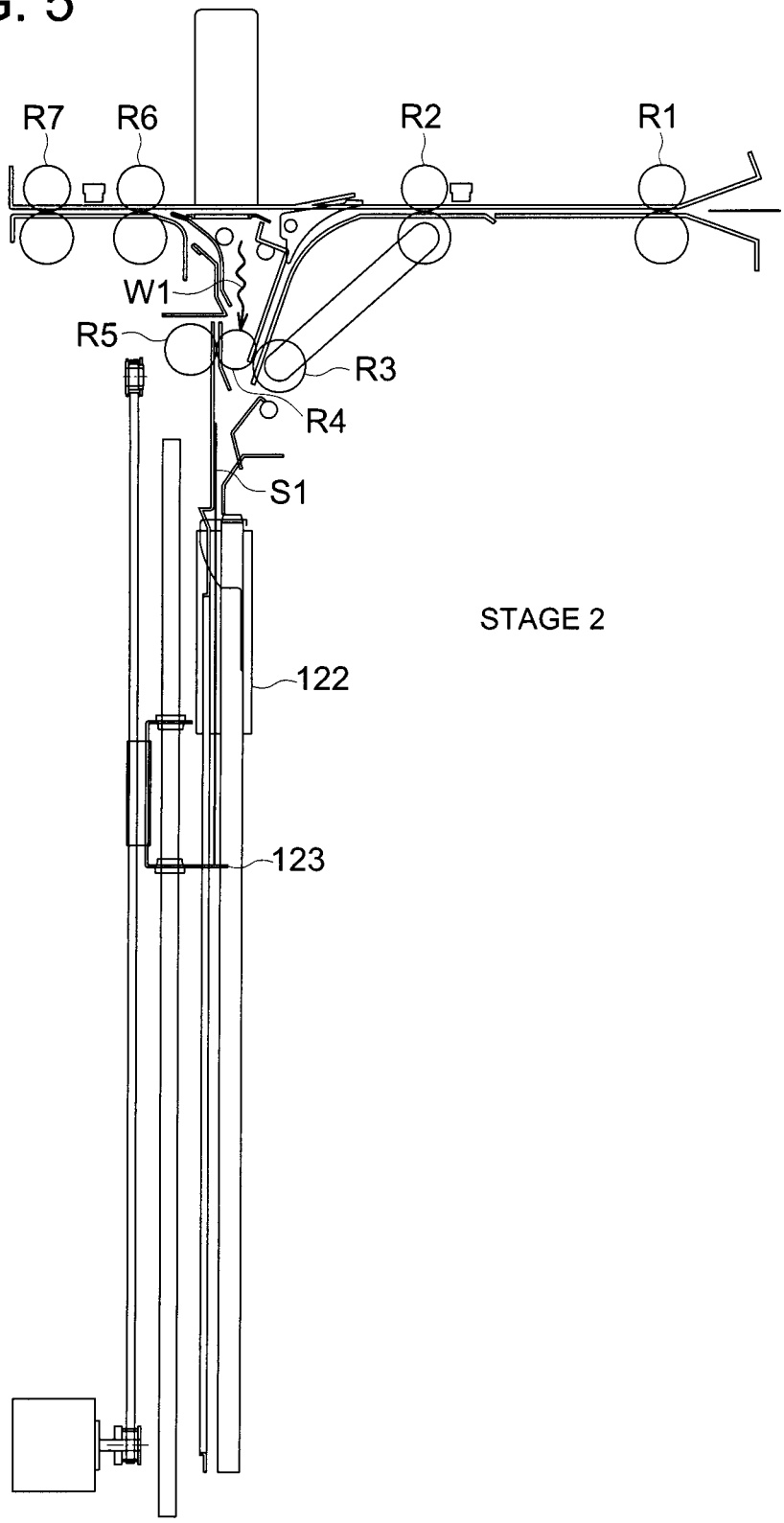
FIG. 5 is a front cross-sectional view of the intermediary conveyance apparatus B.

As a result of sheet entering shown by FIG. 4, as FIG. 5 shows, the sheet S1 stops by contacting with the sheet stopper 123 and the sheet S1 goes into a state shown by FIG. 5 (stage 2).

Figure 6:
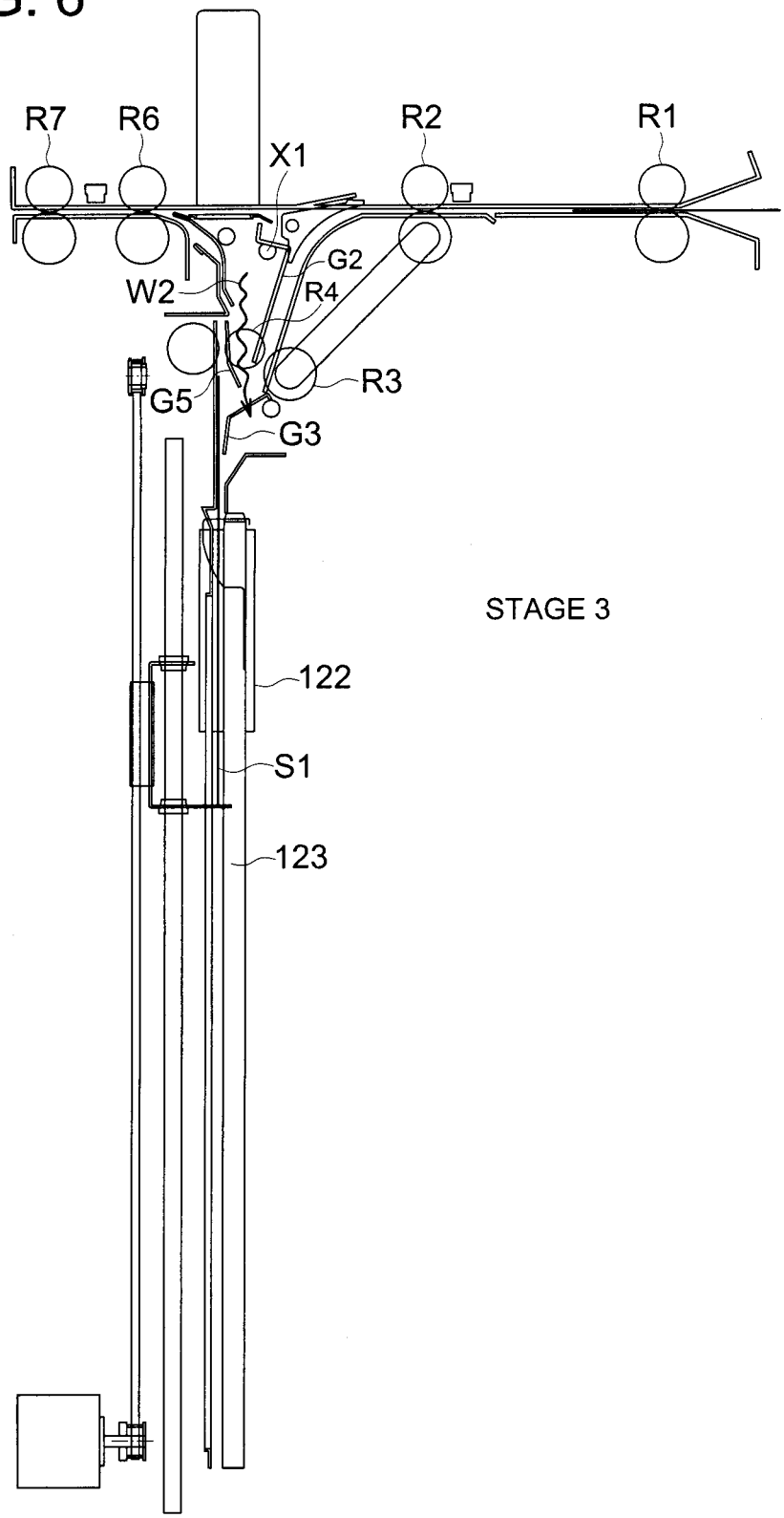
FIG. 6 is a front cross-sectional view of the intermediary conveyance apparatus B.

Next, the sheet S1 goes into a state shown by FIG. 6 (stage 3).

In FIG. 6, the roller R3 is displaced by rotation of a lever which rotates in an anticlockwise direction around a shaft of a lower roller of the roller pair R2 by operating the solenoid SOL1, and a moving block configured with the guide members G2 and G5, and the roller R4 rotates around the axis X1 in an anticlockwise direction by driving the solenoid SOL2.

As a result, as FIG. 6 shows, a gap between the roller R3 and the roller R4 is formed and a gap between the roller R4 and the roller R5 is formed. Also, angles of the guide members G2 and G5 change.

Due to the change of the guide members G2 and G5, the direction of the air current by the fax 126 changes as the air current W2.

The direction of the air current W2 veers the air current away from the sheet storing section 12, as a result the air current in the sheet conveyance path disappears.

In FIG. 13, changeover of the blower device from a high level to a low level and from the low level to the high level is described by on and off of the solenoid SOL2 which displaces the guide member G2 and G5. When the solenoid is turned on, the air blow stops (OFF) and when turning off the solenoid, the air blow starts (ON).

Since the direction of the air current is changed as the result of changing the guide members G2 and G5, as FIG. 13 shows, the timing of changing the guide members G2 and G3 and the timing of changing the direction of the air current coincide.

In the stage shown by FIG. 6, the sheet stopper 123 slightly ascends by the positive rotation of the motor M4, and the guide member G3 rotates in the clockwise direction around the axis X2. By ascending the sheet stopper 123, the upper end of the sheet S1 ascends to a position higher than a lower end of the guide member G5.

By rotating the guide member G3, the sheet S1 is moved to a left side board of the sheet retaining board 121. Also, by aforesaid rotation of the guide members G2 and G5, the direction of the air current changes as shown by W2, thus the sheet S1 retained by the sheet stopper 123 cannot be blown by the air.

As FIG. 6 shows, the upper end of the sheet S1 ascends to the position higher than the lower end of the guide member G5 without contacting with the guide member G5.

In a state of FIG. 6, the motor M3 operated so that the width aligning device 122 aligns the sheet S1 in the width direction.

Figure 7:
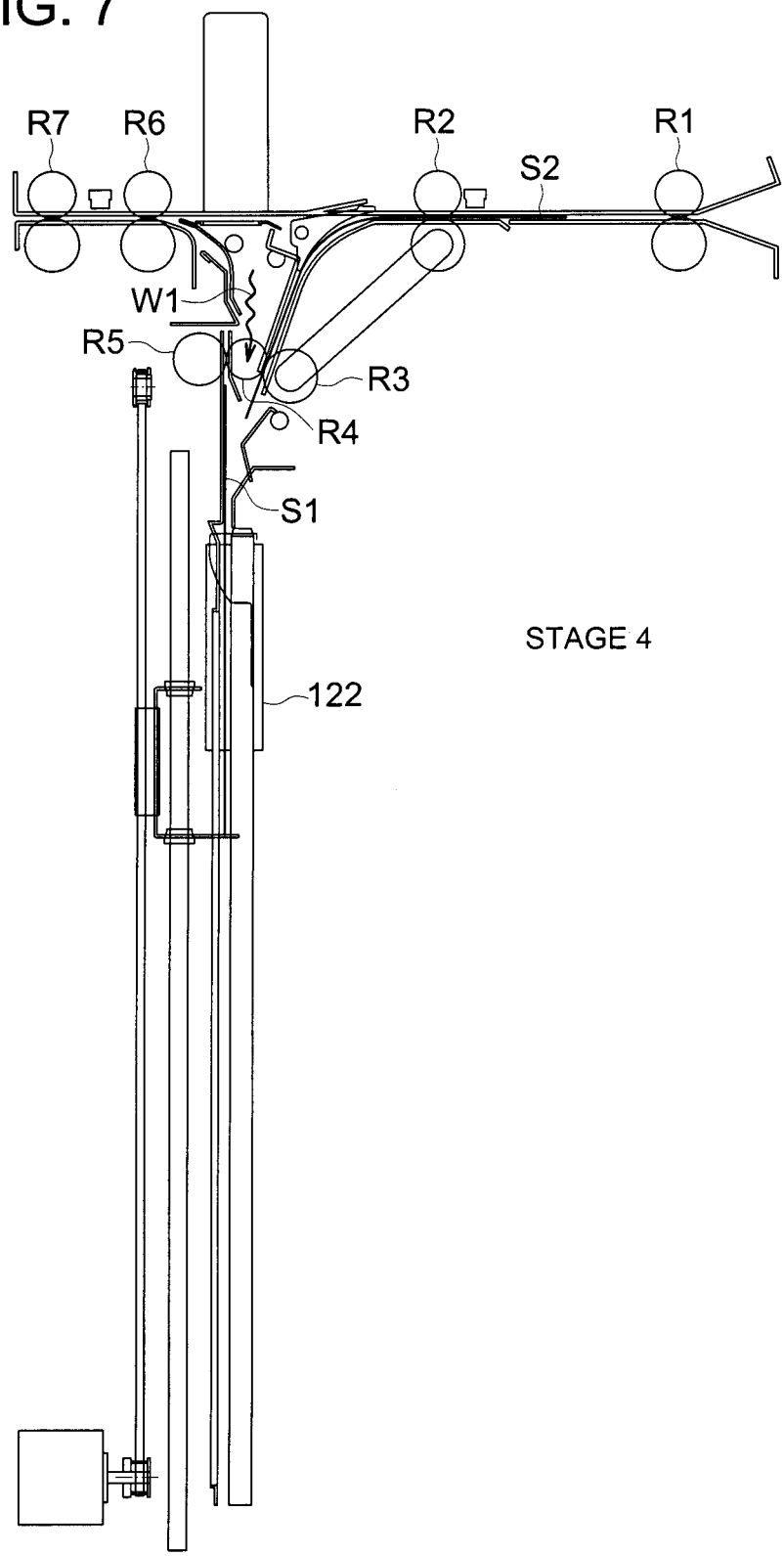
FIG. 7 is a front cross-sectional view of the intermediary conveyance apparatus B.

Next the intermediary conveyance apparatus B goes into a state shown by FIG. 7 (stage 4).

The state of the intermediary conveyance apparatus B in FIG. 7 is the same as that of in FIG. 4 except that the sheet stopper 123 is elevated.

In FIG. 7, the second sheets S2 is nipped by the roller pair R2 and rollers R3 and R4 to be conveyed.

In FIG. 7, the rollers R3, R4 and R5 contact each other and the air current shown by the arrow W1 guides the second sheet S2 and leads it into the sheet storing section 12. As a result, the second sheet S2 enters into the sheet storing section 12 smoothly.

Figure 8:
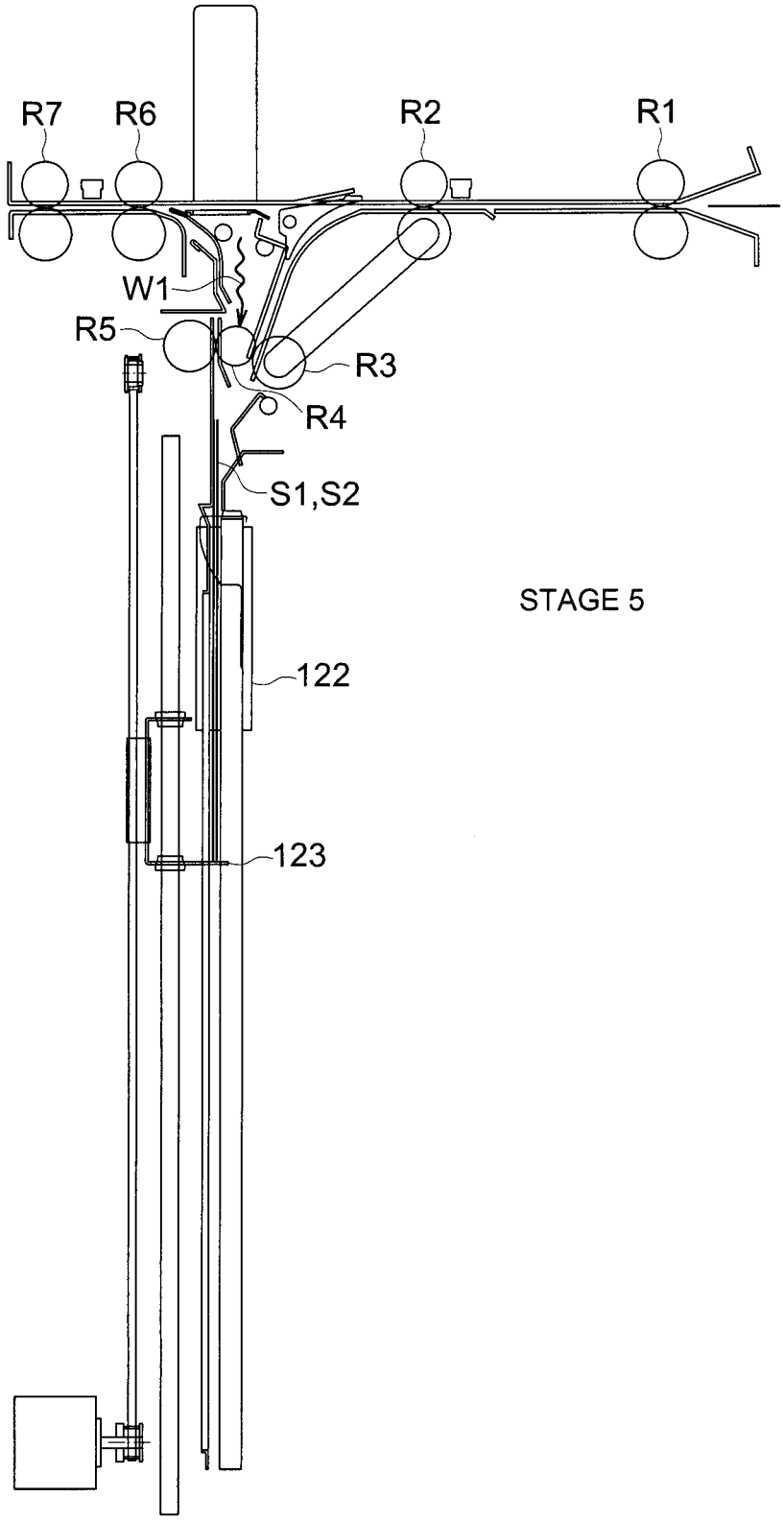
FIG. 8 is a front cross-sectional view of the intermediary conveyance apparatus B.

As FIG. 13 shows, immediately after the stage 4, by rotating the motor M4 in a reverse direction, the sheet stopper 123 descends and is set at a position where the sheet S2 is received, thus the intermediary conveyance apparatus B goes into a stage 5 shown by FIG. 8.

The stage 5 shown by FIG. 8 is the same as that in FIG. 4. In FIG. 8, two sheets S1 and S2 are retained by the sheet stopper 123.

Immediately after the stage 5, the motor M4 operates to ascend the sheet stopper 123.

Figure 9:
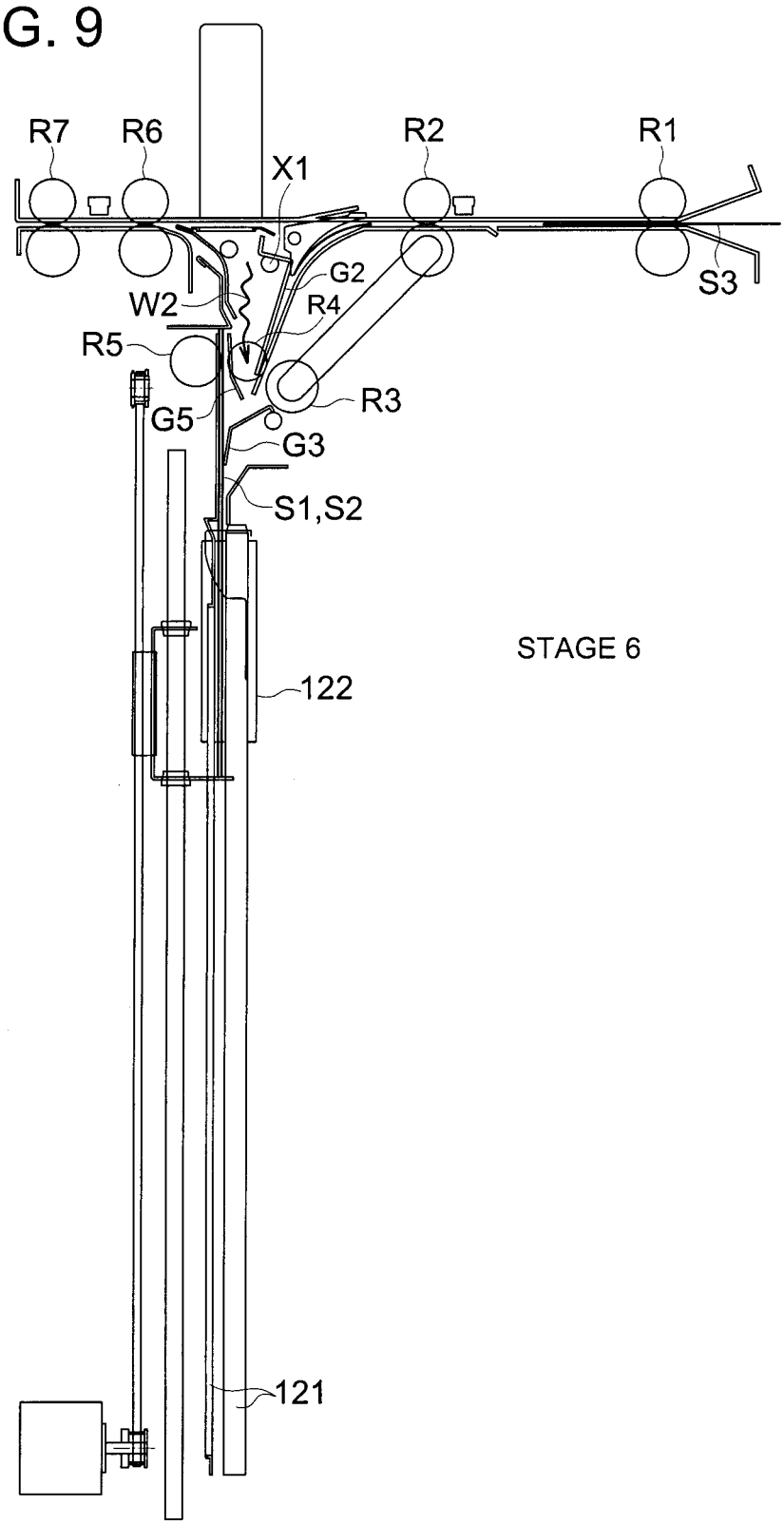
FIG. 9 is a front cross-sectional view of the intermediary conveyance apparatus B.

As a result, the intermediary conveyance apparatus B goes into a state of FIG. 9 (stage 6). In the FIG. 9 the roller R3 displaces and the moving block configured with the guide members G2 and G5 and the roller R4 rotates in the anticlockwise direction around the axis X1. By the above rotation, a gap between the rollers R3 and R4, and a gas between the rollers R4 and R5 are formed. Then as a result of ascent of the sheet stopper 123, the upper ends of the two sheets S1 and S2 ascend to be higher than the rollers R4 and R5.

In FIG. 9, the air current flows in a direction of the arrow W2, and veers away from the sheets S1 and S2, thus ascending of the sheets S1 and S2 is not interrupted by the air current.

As FIG. 9 shows, the gap is formed between the rollers R4 and R5 to release nipping of the sheet and the sheet stopper 123 ascends in a state where the upper ends of the sheets S1 and S2 are stopped by the longitudinal aligning board 128. Whereby, the upper end of the sheets S1 and S2 are aligned and longitudinal aligning is performed.

In FIG. 9, the guide member G3 rotates in the clockwise direction so as to move the sheets S1 and S2 to left side wall of the sheet retaining board 121.

In FIG. 9, a third sheet S3 enters via the roller pair R1.

In FIG. 9, the motor M3 operates and the width aligning device 122 aligns the sheet S2 in the width direction.

Figure 10:
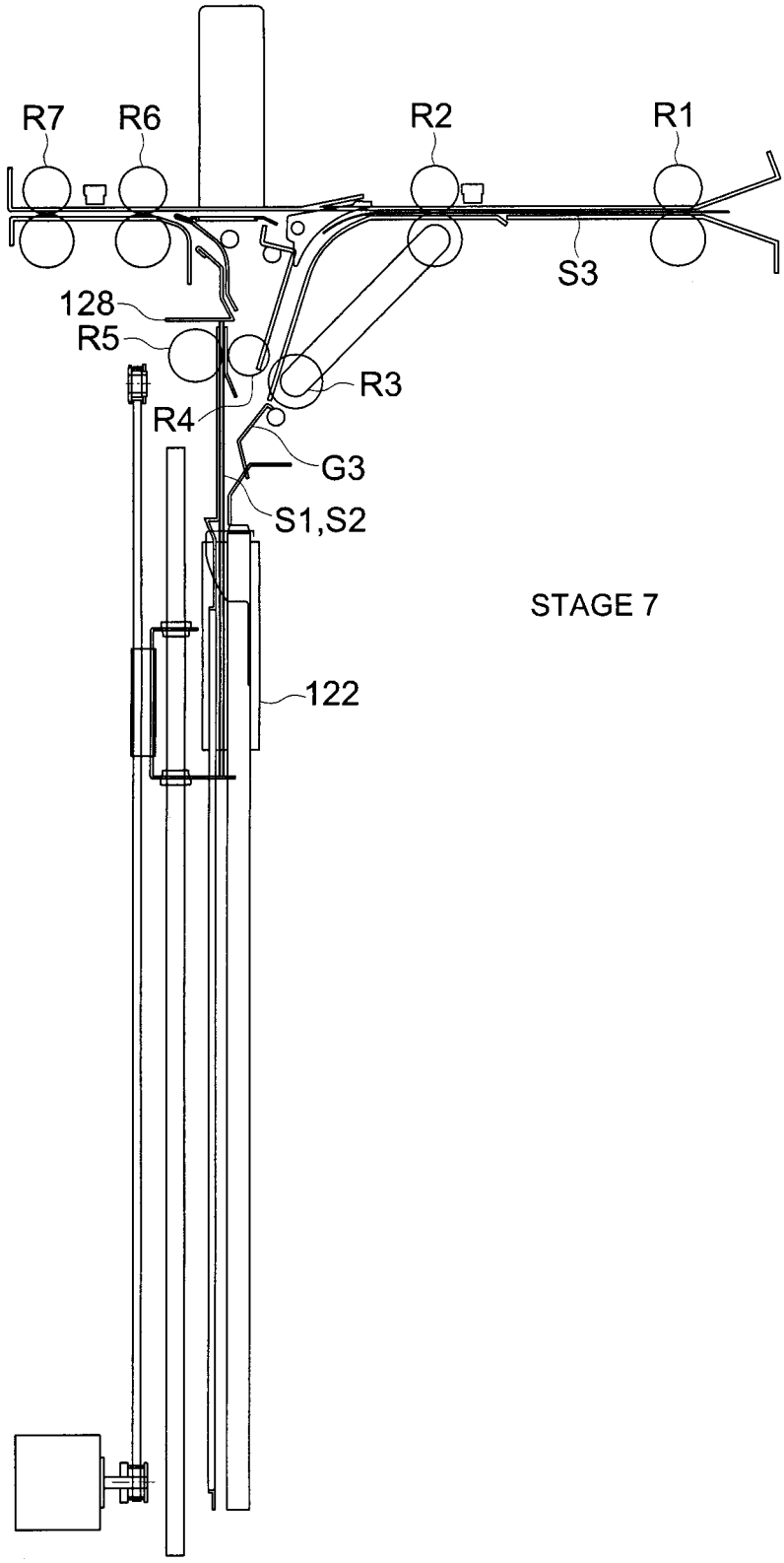
FIG. 10 is a front cross-sectional view of the intermediary conveyance apparatus B.

Next, the intermediary conveyance apparatus B goes into a state shown by FIG. 10 (stage 7). The state shown by FIG. 10 is the same as the state in FIG. 4 except that the sheet stopper 123 is elevated.

In FIG. 10, the upper ends of the sheets S1 and S2 go above the rollers R4 and R5, and the rollers R4 and R5 nip the sheets S1 and S2.

Immediately after the stage 7, solenoid SOL4 operates so that the longitudinal aligning board 128 is retracted from the conveyance path and the guide member G6 rotates in the clockwise direction. Whereby, an discharging conveyance path is formed.

Figure 11:
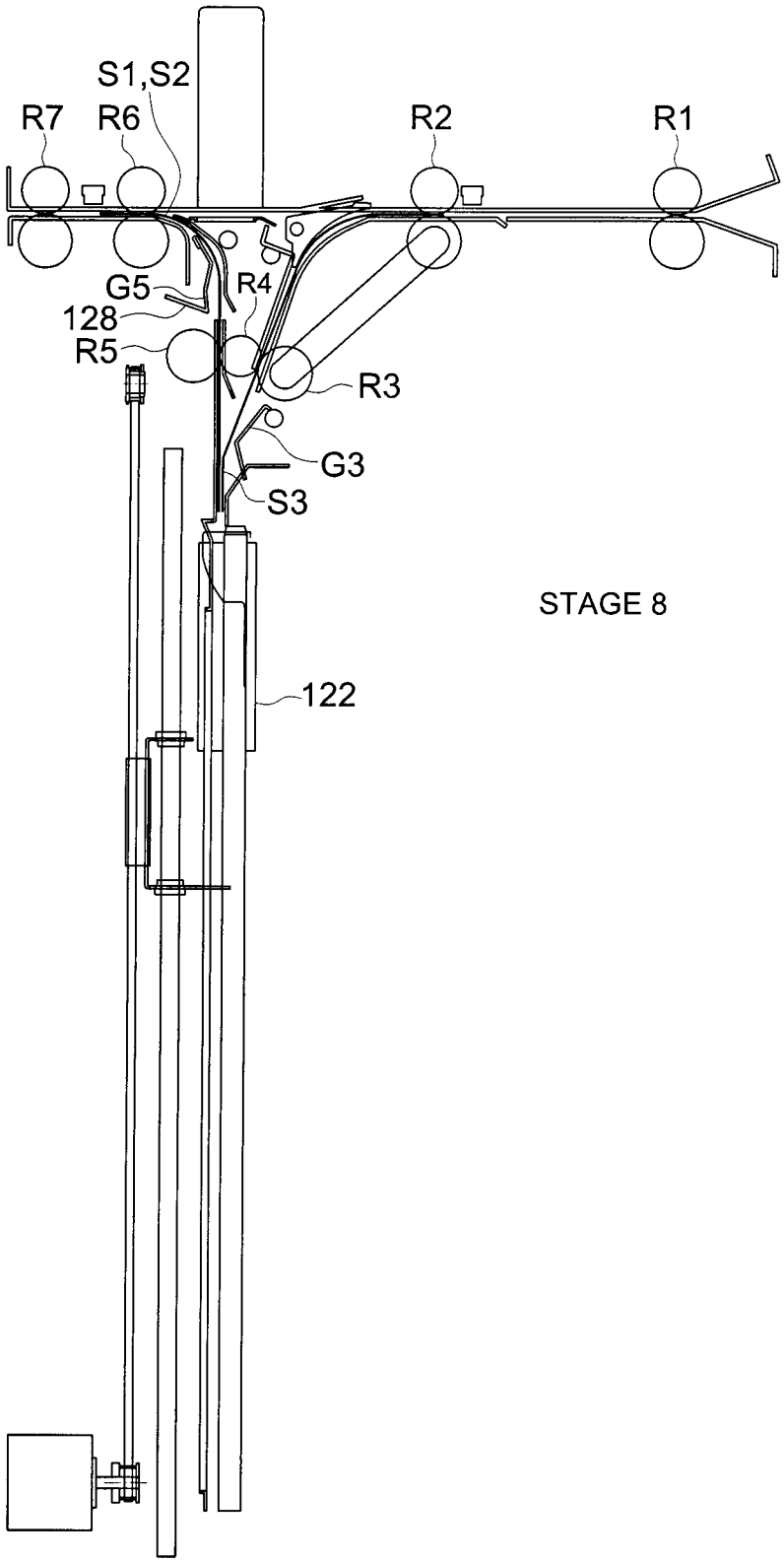
FIG. 11 is a front cross-sectional view of the intermediary conveyance apparatus B.

In the state shown by FIG. 11, the roller R5 and the roller pairs R6 and R7 rotate to discharge the sheets S1 and S2.

By repeating the stages 2 to 8 shown by FIGS. 5 to 11, a continuous conveyance where the sheets are discharged from the intermediary conveyance apparatus B two by two.

Incidentally, it is possible that after storing one sheet or more than three sheets in a reversal conveyance section, the sheets are discharged.

<Operation of Image Forming System>

On the sheet discharging tray 23 of the post-processing apparatus FS, the sheets have to be discharged in a ascending order such as first sheet, second sheet . . . with the image surface side down in case of one-side image forming and with odd pages side down in case of two-side image forming.

The image forming apparatus A can discharge the sheet with the image surface side up (in case of one-side print) hereinafter called linier sheet discharging, and discharge the sheet with the image surface side down (in case of one-side print) hereinafter called reversal sheet discharging.

Also, the intermediary conveyance apparatus B has a linear conveyance function to discharge the sheet without reversing the sheet, and a reversal conveyance function where the sheet is conveyed from the sheet entering section 11 via the sheet storing section 12 to the sheet conveyance section 13 and discharged with reversing the sheet.

The image forming system shown in FIG. 1 can discharge the sheet in order of page number from the post-processing apparatus with a high efficiency by combining the linear sheet discharging function and the reversal sheet discharging function of the image forming apparatus A and the linear sheet conveyance function and the reversal sheet conveyance function of the intermediary conveyance apparatus B.

For example, in a post-processing apparatus having a staple device and a shift device, the sheets brought in the post-processing apparatus FS are discharged to the sheet discharging tray 23 in order of entering without being reversed upside down.

In the above case, the image forming apparatus A performs the linear sheet discharging where the sheet is conveyed and discharged in a highest speed. In the intermediary conveyance apparatus B, the above reversal conveyance is conducted. As the result, the sheet is conveyed to the post-processing apparatus SF with the image surface side down (in case of one-side print), and the sheet is discharged and stacked in order of ascending with the image surface side down on the discharging sheet tray 23.

Even in case a processable number of the sheets per minute of the post processing apparatus FS is smaller than that of the image forming apparatus A, by storing a plurality of the sheets in the sheet storing section 12 of the intermediary conveyance apparatus B, a difference between processing abilities of the image forming apparatus A and the post-processing apparatus FS is absorbed by the intermediary conveyance apparatus B.

There is another case that the image forming apparatus A performs two-side image forming by repeating obverse image forming and reverse image forming alternately.

In the above case, the image forming apparatus A conducts linear sheet discharging and the intermediary conveyance apparatus B conducts linear sheet conveyance.

By the above conveyance, the sheets are discharged and stacked in order of ascending in a manner that the odd page sides face downward. By providing the linear conveyance function in the intermediary conveyance apparatus B, complication of the conveyance path is obviated as above.

The post-processing apparatus FS has at least one of perforation processing, stapling processing, bookbinding processing and shift processing. In accordance with conditions such as the image forming mode (one-side or two-side), a size of the sheet, a kind of the sheet represented by a thick sheet, an environment (temperature and humidity) and processing mode of the post-processing apparatus FS, an optimum combination is selected among the linear sheet discharging or the reversal sheet discharging of the image forming apparatus A and the linear sheet conveyance or the reversal sheet conveyance of the intermediary conveyance apparatus B.

For example, whether or not multiple sheets are stored in the sheet storing section 12 and number of the sheets is determined by comparing a sheet processing speed of the image forming apparatus A and a sheet processing speed of the post-processing apparatus FS.

Incidentally, the conveyance guide of the sheet to the sheet storing section by the blower device is particularly needed in case the sheet storing section 12 stores multiple sheets, namely in case the sheet is conveyed in a state that the sheet exists in the sheet storing section 12.

Whereby, it is preferable that in case the multiple sheets are not stored in the sheet storing section 12, the blower device is not operated.

In the above case, air blow is ceased by stopping the fan 126.

What is claimed is:

1. An intermediary conveyance apparatus having a sheet storing section to store a sheet, a sheet entering section to convey the sheet to the sheet storing section and a sheet discharging section to discharge the sheet stored in the sheet storing section, comprising:

a blower device to blow air to the sheet storing section, the blower device including a restriction member to switch a direction of an air current generated by the blower device; and an intermediary conveyance control device configured to control the blower device, wherein the intermediary conveyance control device controls the restriction member of the blower device to blow air to the sheet storing section when the sheet is conveyed from the sheet entering section to the sheet storing section, and to stop air blow to the sheet storing section when the sheet is discharged from the sheet storing section via the sheet discharging section, by switching the direction of the air current generated by the blower device.

2. The intermediary conveyance apparatus of claim 1, wherein the sheet storing section stores a plurality of the sheets.

3. The intermediary conveyance apparatus of claim 1, wherein the intermediary conveyance control device control the blower section to blow air to the sheet storing section when a plurality of the sheets are stored in the sheet storing section and to stop air blow when the plurality of the sheets are not stored in the sheet storing section.

4. The intermediary conveyance apparatus of claim 1, wherein the sheet storing section reverses the sheet in a way that a conveyance direction of the sheet when the sheet is conveyed from the sheet entering section opposes a conveyance direction of the sheet when the sheet is discharged from the sheet discharging section.

5. The intermediary conveyance apparatus of claim 1, wherein the intermediary conveyance control device controls the blower device based on a sheet detection signal of a sensor provided at the sheet entering section.

6. The intermediary conveyance apparatus of claim 1, wherein the sheet storing section stores the sheet in a vertical state and the blower device is provided with a fan disposed above the sheet storing section.

7. The intermediary conveyance apparatus of claim 6, further comprising:

a conveyance path to convey the sheet from the sheet entering section to the sheet discharging section without passing through the sheet storing section, and a guide member configuring the conveyance path is provided with a hole through which the air current from the fan goes.

8. The intermediary conveyance apparatus of claim 1, wherein the sheet entering section is provided with a guide member for restriction to move the sheet stored in the sheet storing section to a sheet discharging side.

9. An image forming system, having an image forming apparatus, the intermediary conveyance apparatus of claim 1, and a post-processing apparatus, to convey the sheet from the image forming apparatus to the post processing apparatus via the intermediary conveyance apparatus, wherein the image forming apparatus includes a linear sheet discharging function, a reversal sheet discharging function and a main control device, the intermediary conveyance apparatus includes a linear conveyance function and a reversal conveyance function, the main control device selects the linear sheet discharging function or the reversal sheet discharging function, and the intermediary conveyance control device selects and uses the linear conveyance function or the reversal conveyance function based on information acquired from the main control device.

10. The image forming system of claim 9, wherein the intermediary conveyance control device selects the linear conveyance function or the reversal conveyance function based on at least one item of information from the main control device, the at least one item of information regarding at least one of image forming mode in the image forming apparatus, a size of the sheet, a kind of the sheet, an environment, or post-processing in the post-processing apparatus.

11. An intermediary conveyance apparatus having a sheet storing section to store a sheet, a sheet entering section to convey the sheet to the sheet storing section and a sheet discharging section to discharge the sheet stored in the sheet storing section, comprising:

a blower device to blow air to the sheet storing section, the blower device including a restriction member to switch a direction of an air current generated by the blower device;

a sheet aligning device to align the sheet stored in the sheet storing section; and an intermediary conveyance control device to control the restriction member of the blower device and the sheet aligning device, wherein the intermediary conveyance control device controls the aligning device and the restriction member of the blower device to blow air to the sheet storing section when the sheet is conveyed from the sheet entering section to the sheet storing section, and to stop air blow to the sheet storing section while an aligning process by the sheet aligning device is performed, by switching the direction of the air current generated by the blower device.

12. The intermediary conveyance apparatus of claim 11, wherein the sheet aligning device performs longitudinal aligning.

* * * * *